US007814591B2

(12) United States Patent
Weiler

(10) Patent No.: US 7,814,591 B2
(45) Date of Patent: Oct. 19, 2010

(54) PATIENT POSITIONING DEVICE

(75) Inventor: Herbert Weiler, Alling (DE)

(73) Assignee: Siemens Aktiengesellschaft, Munich (DE)

( * ) Notice: Subject to any disclaimer, the term of this patent is extended or adjusted under 35 U.S.C. 154(b) by 209 days.

(21) Appl. No.: 11/661,510

(22) PCT Filed: Aug. 23, 2005

(86) PCT No.: PCT/EP2005/054132

§ 371 (c)(1),
(2), (4) Date: Jan. 28, 2008

(87) PCT Pub. No.: WO2006/024613

PCT Pub. Date: Mar. 9, 2006

(65) Prior Publication Data

US 2008/0256709 A1 Oct. 23, 2008

(30) Foreign Application Priority Data

Sep. 1, 2004 (DE) ..... 10 2004 042 315

(51) Int. Cl.
*A61G 7/012* (2006.01)
*A61G 7/08* (2006.01)

(52) U.S. Cl. ..... 5/611; 5/86.1; 5/601

(58) Field of Classification Search ..... 5/86.1, 5/81.1 R, 601, 620, 600, 611, 11
See application file for complete search history.

(56) References Cited

U.S. PATENT DOCUMENTS

| | | | | |
|---|---|---|---|---|
| 3,564,625 | A * | 2/1971 | Danielson | 5/87.1 |
| 4,679,261 | A * | 7/1987 | Stanley et al. | 5/183 |
| 4,939,801 | A * | 7/1990 | Schaal et al. | 5/607 |
| 5,319,817 | A * | 6/1994 | Hay et al. | 5/611 |
| 5,475,884 | A | 12/1995 | Kirmse et al. | |
| 6,006,376 | A * | 12/1999 | Williamson | 5/81.1 R |
| 6,651,280 | B2 | 11/2003 | Blevins | |
| 6,854,140 | B2 | 2/2005 | Bartels et al. | |
| 2008/0256709 | A1 * | 10/2008 | Weiler | 5/611 |

FOREIGN PATENT DOCUMENTS

| | | | |
|---|---|---|---|
| DE | 1 282 850 | B | 11/1968 |
| DE | 1282850 | | 11/1968 |
| DE | 101 13 855 | A1 | 10/2002 |
| EP | 0 947 187 | A2 | 10/1999 |
| GB | 961677 | | 6/1964 |
| GB | 961677 | A | 6/1964 |
| GB | 2 319 226 | A | 5/1998 |
| WO | WO 02/098294 | A1 | 12/2002 |

OTHER PUBLICATIONS

German Office Action for DE 10 2004 042 315.6-26 dated Apr. 15, 2005 and English translation.
International Search Report for PCT/EP2005/054132 dated Aug. 23, 2005.
Krause; Konstruktionselemente der Feinmechanik, 2. Auflage, 1993, p. 411-414, 445-462; Carl Hanser-Verlag München-Wien; 2; ISBN 3-446-16530-4; Book; 1993.

* cited by examiner

*Primary Examiner*—Robert G Santos
(74) *Attorney, Agent, or Firm*—Brinks, Hofer, Gilson & Lione

(57) ABSTRACT

A patient positioning device is provided. The patient positioning device includes a patient positioning top and a u-shaped undercarriage that includes first and second parts that can be displaced relative to each other. An undercarriage length is adjustable with the first and second parts.

16 Claims, 1 Drawing Sheet

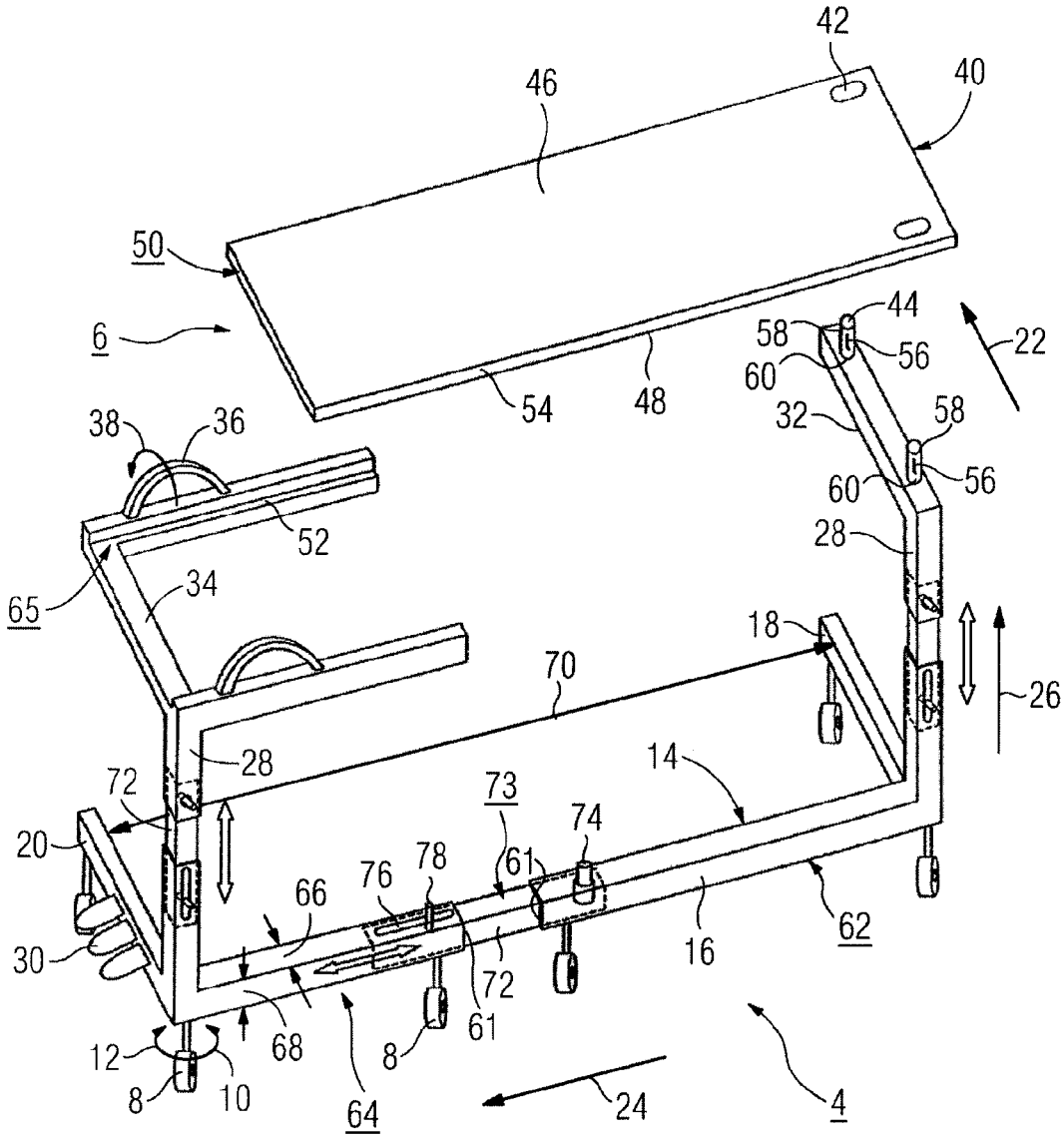
42
40
46
50
6
44
58
56
22
60
54
48
32
58
38
36
60
56
52
28
65
34
18
70
26
28
14
72
73
74
20
76
78
61
66
62
30
16
72
68
61
12
8
8
10
64
24
4

PATIENT POSITIONING DEVICE

The present patent document is a §371 nationalization of PCT Application Serial Number PCT/EP2005/054132, filed Aug. 23, 2005, designating the United States, which is hereby incorporated by reference. This patent document also claims the benefit of DE 10 2004 042 315.6, filed Sep. 1, 2004.

BACKGROUND

The present embodiments relate to a patient positioning device.

Patient positioning devices that include a u-shaped undercarriage are used to transport an acute patient from the emergency room, to a radiology room for x-ray examinations, to the operating room for treatment, and finally to a patient room for the aftercare of the patient. The patient lies on a patient positioning top that is mounted to the undercarriage. The patient positioning top is affixed to the undercarriage in a detachable manner, so that the patient lying on the mounting plate can be positioned together with the patient positioning top for an x-ray examination on, for example, a computer tomography table.

DE 101 13 855 A1 discloses a patient positioning device. A transport trolley with a patient positioning top is proposed in DE 101 13 855 A1. The patient positioning top can be attached to the transport trolley in a fixable manner by the extension arms of the transport trolley. The extension arms are fastened to telescopic pillars of the transport trolley. The patient positioning top is height-adjustable by the telescopic pillars. The u- or c-shaped design of the undercarriage allows a patient lying on the mounting plate to be moved directly over, for example, a computer tomography table for an x-ray examination. By lifting the computer tomography table, the patient and the patient positioning top, which is arranged in a detachable fashion on the undercarriage, are lifted onto the computer tomography table.

The u and/or c-shaped design of the undercarriage is designed for a specific maximum length of typical computer tomography or operating tables.

SUMMARY

The present embodiments may obviate one or more of the drawbacks or limitations inherent in the related art. For example, in one embodiment, a patient position device is able to easily position a patient between patient treatment tables of any size.

In one embodiment, a patient position device for a patient positioning top includes a u-shaped undercarriage. The length of the undercarriage can be adjusted, using a guide, by two parts that can be displaced against each other.

The patient located on the patient positioning top can be moved over a patient treatment table of any length using the u-shaped design of the undercarriage. The undercarriage includes angled cross frames on two opposing ends of a longitudinal frame. The cross frames have a comparatively small scale in terms of length and are preferably arranged at right angles to the longitudinal frame.

The undercarriage can be moved to the patient treatment table, for example, a computer tomography table or an operating table. Due to the longitudinal frame of the undercarriage which may be adjustable in terms of length, the patient and the patient positioning top can be moved over the patient table such that the u-shaped undercarriage surrounds the patient table in the manner of a square bracket that is opened in the direction of the patient table. The patient positioning top with the patient located thereupon can be detached from the undercarriage by lifting the patient treatment table.

The undercarriage includes two parts that can be displaced against each other and form the longitudinal frame in order to adjust its undercarriage length. A first part of the longitudinal frame of the undercarriage includes a housing inner diameter. The housing inner diameter has a marginally larger scale or size compared with the housing external diameter of the second part of the longitudinal frame of the undercarriage. Both parts on the longitudinal frame form a guide in order to adjust the length of the undercarriage.

The patient positioning top is affixed to the undercarriage in a detachable manner. The patient positioning top is clamped to a first plate end with the first part of the undercarriage using a locking mechanism in a locking position. With respect to the mode of operation of such a locking mechanism, reference is made to "Krause, Konstruktionselemente der Feinmechanik" [Krause, construction elements of precision mechanics], $2^{nd}$ edition, Carl Hanser-Verlag Munich-Vienna, 1993, ISBN 3-446-16530-4, page 445 ff.

The patient positioning top on the undercarriage is expediently mounted in a moveable manner to a second plate end lying against the first plate end of the mounting plate, according to a guide slide bearing. Both parts of the undercarriage can be displaced against each other in order to adjust the undercarriage length without adjusting the length of the patient positioning top. The guide slide bearing of the patient positioning top on the undercarriage centers the second plate end of the patient positioning top on the undercarriage. With respect to the mode of operation of a guide, reference is made to "Krause, Konstruktionselemente der Feinmechanik" [Krause, construction elements of precision mechanics], $2^{nd}$ edition, Carl Hanser-Verlag Munich-Vienna, 1993, ISBN 3-446-16530-4, page 411.

The outer surfaces of the undercarriage, upon which the second plate end of the mounting plate is mounted in a moveable fashion, are expediently designed as guide surfaces. The guide surfaces include edges provided on the second plate end of the mounting plate. The guide surfaces contribute to an improved movability of the mounting plate on the undercarriage when adjusting the undercarriage length and centering the mounting plate on the undercarriage.

In one embodiment, the undercarriage includes a rail on the parts which can be displaced against each another. The housing outer surfaces of which rail with the inner surfaces of the parts of the undercarriage formed from the frame-like housings form a guide in order to improve movability of the parts. The inner surfaces of the parts of the undercarriage, which form the guide surfaces for the housing outer surfaces of the rails, are designed as inner surfaces according to a type of cylinder or cuboid. If the housing frame of the parts of the undercarriage are designed to be cuboid with housing inner surfaces, which are arranged at right angles to one another, the outer surfaces of the rails are likewise designed to be at right angles to one another such that the housing inner surfaces of the parts with the housing outer surface of the rails form a guide for adjusting the undercarriage length.

To attach the patient positioning top to the undercarriage in a detachable manner, at least one guide eye (hole) is expediently provided on the first plate end of the mounting plate. A guide bolt is arranged on the first part of the undercarriage. The guide bolt is arranged in a vertically upright manner. The guide bolt is guided into the mounting plate by the guide eye when the mounting plate is attached to the undercarriage.

To attach and fasten the mounting plate to the undercarriage in a particularly time-saving and simple manner, the guide eye incorporated into the mounting plate is designed to be vertical to the mounting plate from one plate side to a plate side of the mounting plate opposite to this. The guide eye is designed as a slot in the longitudinal direction of the patient positioning end. A patient positioning top, which is not arranged horizontally over the undercarriage, can be easily attached.

The patient positioning end is expediently attached to the undercarriage. The mounting plate is prevented from sliding. In one embodiment, the mounting plate is attached to the undercarriage by way of a grid element arranged on the guide bolt of the undercarriage. The grid element is designed in one piece with the guide bolt. The grid element serves as a blocking element when the patient positioning top is coupled to the undercarriage. To load the patient positioning top in a particularly reliable manner during closure, the grid element designed as one piece with the guide bolt is designed as a handle. The handle is connected to the guide bolt with a fixed end and loads the patient positioning top with a free end facing away from the fixed end, in a closed manner.

The undercarriage is height-adjustable as well as length-adjustable in order to suitably adjust the undercarriage not only to the length, but also to the height of the patient treatment table. The patient is able to be positioned without any effort on the patient treatment table. A hydraulics device is provided on the undercarriage in order adjust the undercarriage in terms of height and length. The hydraulics device can be operated by way of pedals arranged on the undercarriage. The hydraulics device is preferably designed as a Trendelenburg hydraulics system.

In one embodiment, the patient positioning top, upon which the patient is located and which is detached from the undercarriage by lifting a computer tomography table or an operating table for instance, is made from an x-ray permeable material. Accordingly, a patient positioning top mounted on the computer tomography table together with the patient for the x-ray examination is no obstacle.

BRIEF DESCRIPTION OF THE DRAWINGS

FIG. 1 is a perspective view of one embodiment of a patient positioning device for a patient positioning top.

DETAILED DESCRIPTION

As shown in FIG. 1, the patient position device includes an undercarriage 4 and a patient positioning plate 6. The patient positioning top is attached to the undercarriage 4. The undercarriage is provided with rollers 8 in order to transport a patient located on the patient positioning plate 6. To control the undercarriage 4 in a particularly smooth manner, the rollers 8 are rotatably connected to the undercarriage 4 in a horizontal direction 10, 12.

The undercarriage 4 includes a u-shaped frame 14. The u-shaped frame 14 includes a longitudinal frame 16 and two cross frames 18, 20 arranged at an angle to the longitudinal frame 16. The longitudinal frame 16 has a comparatively larger scale in terms of length than the cross frames 18, 20. The length of the cross frames 18, 20 can be suitably designed such that when positioning and transporting the patient, an inclination (tilting) of the undercarriage 4 is avoided.

The patient position device includes an undercarriage 4 that can be adjusted in terms of height and length. The patient position device is used to move the patient from the emergency room into the patient room using only the patient positioning plate 6. The patient positioning plate 6 is detached from the undercarriage 4 without positioning the patient and positioned onto, for example, a computer tomography table or an operating table for instance.

The undercarriage 4 is moved in direction 22 to the patient treatment table in order to position the patient. The patient is located on the patient positioning plate 6, on a patient treatment table, for example, a computer tomography table. As a function of the size of the patient treatment table, the height of the patient positioning plate 6 can be adjusted to the pillars 28 by way of the undercarriage 4. The undercarriage 4 is u-shaped so that the patient positioning plate 6 can be moved over the patient treatment table. The patient treatment table is surrounded by the longitudinal frame 16 and the cross frames 18, 20 of the undercarriage 4. To enable this, the length of the undercarriage can be adjusted by way of the longitudinal frame 16.

The height of the patient positioning plate 6 can be adjusted to the pillars 28 by the undercarriage 4. The undercarriage length on the longitudinal frame 16 can be adjusted by pedals 30. By activating the pedals 30, a hydraulics system arranged on the undercarriage 4 is controlled. The hydraulics system is preferably a Trendelenburg hydraulics system, which is conventionally used for patient trolleys. The hydraulics system adjusts the height of the undercarriage 4 in and counter to direction 26. The hydraulics system also adjusts the length of the undercarriage in and counter to direction 24.

If the undercarriage 4 is moved on the patient positioning table such that the patient and the patient positioning plate 6 are disposed directly above the patient treatment table, the patient positioning plate 6 can be lifted away from the undercarriage 4 by accelerating the patient treatment table and can be detached from the undercarriage 4. As the upper part of the undercarriage 4, on which the patient positioning plate 6 is mounted and which includes frame pieces 32 and 34, is open on both sides of the undercarriage 4, the undercarriage 4 can be moved away from the patient treatment table after detaching the mounting plate 6.

Two handles 36 are attached to the frame piece 34. The two handles 36 improve the control of the undercarriage 4. The handles 36 are arranged in a rotatable manner on frame 34 in a vertical direction 38.

After moving the undercarriage 4 away from the patient treatment table, the patient is again located on the patient positioning plate 6, which is now not mounted to the undercarriage 4, but instead to the patient treatment table. The patient may be subject to an x-ray examination. The patient positioning plate 6 is made from an x-ray permeable material. After treating the patient, the patient can be transported by connecting the patient positioning plate 6 to the undercarriage 4, which is backed up again to the patient treatment table.

Two guide eyes 42 are provided on one plate end 40 of the mounting plate 6. When the mounting plate 6 is connected to the undercarriage 4, guide bolts 44 provided on the undercarriage 4 are guided through the guide eyes 42. The guide eyes 42 are designed such that they pass through from the one plate side 46 to the opposing plate side 48 of the mounting plate 6. In one embodiment the guide bolts 44 are arranged upright and vertical to the frame piece 32 and are made in one piece with the undercarriage 4.

The guide eyes 42 are designed as slots in the longitudinal direction 24 of the mounting plate 6. The patient positioning plate 6, which is not arranged in parallel to the undercarriage 4 as a result of an inclined patient treatment table, can be connected to the undercarriage 4 without any problem.

The patient positioning plate 6 is affixed to the plate end 40 in a coupled state using the guide bolts 44 guided through the guide eyes 42 in directions 22 and 24. A plate end 50 opposing the plate end 40 is mounted on the frame piece 34 as a free end. The outer surfaces 52 of the frame piece 34 of the undercarriage 4 form two guide surfaces as components of the guide slide bearing formed with edges 54 of the mounting plate 6 in order to guide the patient positioning plate 6 when adjusting the length of the undercarriage 4. This guide slide bearing centers the patient positioning plate 6 during connection to the undercarriage 4 and improves the movement of the mounting plate 6 on the undercarriage 4. The mounting plate 6 is affixed to the plate end 40 in direction 22 and can be mounted in a moveable manner in direction 24.

Grid elements 56 are arranged on the guide bolts 44 in order to safely transport the positioning plate 6 together with the patient on the undercarriage 4. The grid elements 56 are, in one embodiment, designed in one piece with the guide bolts 44. If the mounting plate 6 is coupled to the undercarriage 4, the grid elements 56 operate as blocking elements in order to load the mounting plate 6 during closure. The plate end 40 of the mounting plate 6 is fixed in direction 26. The respective grid element 56 is a type of handle, which is connected to the respective guide bolts 44 with a fixed end. The handle supplies the patient positioning plate 6 with a free end facing away from the fixed end during closure.

In one embodiment, the square-shaped housing frame of both the frame part 62 and also the frame part 64 includes the same frame width 66 and the same frame height 68.

A rail 72 serves to adjust the undercarriage length in or opposite to a direction 24. The outer surfaces 73 of the rail 72 include marginally smaller scales than the inner surfaces of the frame housing of the frame parts 62, 64. The rail 72 is affixed to the frame part 62 with a bolt 74 and is mounted to the frame part 64 in a moveable manner using a guide rail 76. When adjusting the undercarriage length using a Trendelenburg hydraulics system, a bolt 78 prevents the rail 72 from sliding out from the frame part 64 and prevents the patient positioning plate 6 with the plate end 50 from becoming detached from a guide slide bearing formed by the outer surface 52 of the frame piece 34 and the edge 54 of mounting plate 6. The height of the undercarriage can be adjusted using a rail 72 arranged in a moveable manner in each instance on frame part 62 and on frame part 64.

In one embodiment, the scales of a housing frame of the frame part 62 are designed such that the outer surfaces of the housing frame of the frame part 62 as guide surfaces form components of a guide formed with the inner surfaces of a housing frame of the frame part 64. The housing frames of both frame parts 62, 64 can be displaced directly against each other.

An adjustable undercarriage length of the undercarriage 4 allows a patient to be transported easily and in a time-saving manner from the emergency room to an individual patient treatment table and positioned on the patient treatment table. By adjusting the undercarriage 4 in terms of height and length, the patient positioning device can be adjusted to a patient treatment table of practically any size. The simple height and length adjustment of the undercarriage 4 by Trendelenburg hydraulics systems results in cost-savings for a hospital. By designing the frame pieces 32, 34 of the undercarriage 4 for the purpose of mounting the patient positioning plate 6, a simple attachment and detachment of the patient mounting plate 6 with the patient from the undercarriage 4 and a reliable transportation of the patient is ensured with the patient position device.

Various embodiments described herein can be used alone or in combination with one another. The forgoing detailed description has described only a few of the many possible implementations of the present invention. For this reason, this detailed description is intended by way of illustration, and not by way of limitation. It is only the following claims, including all equivalents that are intended to define the scope of this invention.

The invention claimed is:

1. A patient positioning device for transporting a patient, the patient positioning device comprising:

a patient positioning top; and a u-shaped undercarriage having a longitudinal frame, the longitudinal frame having a first cross frame on one end of the longitudinal frame and a second cross frame on an opposite end of the longitudinal frame, the first and second cross frames being configured to support a patient positioning top, wherein an undercarriage length is adjustable using a first part of the longitudinal frame that is displaceable counter to a second part of the longitudinal frame, and wherein the patient positioning top includes a first plate end and a second plate end, the first part including a locking mechanism that is operable to lock the first plate end of the patient positioning top on the first part of the longitudinal frame, while the second plate end of the patient positioning top is moveable on the second part of the longitudinal frame along a guide slide bearing.

2. The patient positioning device as claimed in claim 1, further comprising a rail, which is inserted into the first part and second part, so that an inner surface of the first part and second part guide the outer surface of the rail.

3. The patient positioning device as claimed in claim 2, wherein the inner surfaces are arranged at right angles to one another.

4. The patient positioning device as claimed in claim 1, wherein the guide slide bearing includes exterior surfaces of the second part that are guide surfaces that correspond to edges of the patient position top, the second plate end being centered on the undercarriage and the patient positioning top being moveable on the undercarriage.

5. The patient positioning device as claimed in claim 1, wherein the first part includes a vertically upright guide bolt, the guide bolt being able to be guided by a guide eye in the patient positioning top.

6. The patient positioning device as claimed in claim 5, wherein the locking mechanism includes a handle arranged on the guide bolt, the handle being operable to block the patient positioning top loaded during a closure.

7. The patient positioning device as claimed in claim 6, wherein the guide eye is a slot in the longitudinal direction of the patient positioning top.

8. The patient positioning device as claimed in claim 7, wherein the handle is connected to the guide bolt with a fixed end and loads the patient positioning top with a free end facing away from the fixed end during closure.

9. The patient positioning device as claimed in claim 1, wherein the u-shaped undercarriage comprises a two-part longitudinal frame and two cross frames that are disposed at right angles from the ends of the longitudinal frame.

10. The patient positioning device as claimed in claim 1, wherein the undercarriage includes frame pieces that are height-adjustable, the frame pieces being displaced against the first and second parts.

11. The patient positioning device as claimed in claim 10, wherein a hydraulic system is operable to adjust a height and length of the undercarriage.

12. The patient positioning device as claimed in claim 1, wherein the first plate end of the patient positioning top is disposed at an opposite end of the second plate end of the patient positioning top.

13. The patient positioning device as claimed in claim 1, wherein the guide slide bearing includes inner surfaces of the first and second parts that correspond to an outer surface of a rail.

14. The patient positioning device as claimed in claim 13, wherein the guide slide bearing includes exterior surfaces of the second part that are guide surfaces that correspond to edges of the patient positioning top, the second plate end being centered on the undercarriage and the patient positioning top being moveable on the undercarriage.

15. The patient positioning device as claimed in claim 1, wherein the undercarriage includes frame pieces that are displaced against the first and second parts.

16. The patient positioning device as claimed in claim 15, wherein a hydraulic system is operable to adjust a height and length of the undercarriage.

* * * * *